US006515538B2

(12) United States Patent
Ono et al.

(10) Patent No.: US 6,515,538 B2
(45) Date of Patent: Feb. 4, 2003

(54) ACTIVE BIAS CIRCUIT HAVING WILSON AND WIDLAR CONFIGURATIONS

(75) Inventors: Fuminobu Ono, Tokyo (JP); Yoshikazu Nishimura, Tokyo (JP)

(73) Assignee: NEC Compound Semiconductor Devices, Ltd. (JP)

( * ) Notice: Subject to any disclaimer, the term of this patent is extended or adjusted under 35 U.S.C. 154(b) by 0 days.

(21) Appl. No.: 09/837,730

(22) Filed: Apr. 18, 2001

(65) Prior Publication Data

US 2001/0033194 A1 Oct. 25, 2001

(30) Foreign Application Priority Data

Apr. 19, 2000 (JP) ..... 2000-118443

(51) Int. Cl.[7] ..... G05F 1/10; G05F 3/02
(52) U.S. Cl. ..... 327/541; 323/315
(58) Field of Search ..... 327/538, 540, 327/541, 543; 323/312, 315

(56) References Cited

U.S. PATENT DOCUMENTS 3,936,725 A * 2/1976 Schneider ..... 323/315
5,448,174 A * 9/1995 Gose et al. ..... 327/262
5,825,167 A * 10/1998 Ryat ..... 323/312

* cited by examiner

*Primary Examiner*—Terry D. Cunningham
*Assistant Examiner*—Quan Tra
(74) *Attorney, Agent, or Firm*—Hayes Soloway PC

(57) ABSTRACT

An active bias circuit having a combined configuration of the Wilson and Widlar current source configurations is provided, which makes it possible to set the output bias voltage at approximately zero (OV) even if a reference voltage applied to generate a reference current does not reach OV. This circuit comprises cascode-connected first and second transistors cascode-connected third and fourth transistors, and a resistor with a specific voltage drop generated by a current flowing through the same. The absolute value of the output bias voltage is decreased by the value of the voltage drop of the resistor compared with the case where the resistor is not provided. The resistor is provided between the gates/bases of the first and third transistors, or between the gate/base and source/emitter of the fourth transistor.

3 Claims, 5 Drawing Sheets

ACTIVE BIAS CIRCUIT HAVING WILSON AND WIDLAR CONFIGURATIONS

BACKGROUND OF THE INVENTION

1. Field of the Invention

The present invention relates to an active bias circuit and more particularly, to an active bias circuit with a combined configuration of the Wilson configuration for current source and the Widlar configuration for current source.

2. Description of the Related Art

FIG. 1 shows a conventional active bias circuit 10 having a combined configuration of the Wilson and Widlar current source configurations As shown in FIG. 1, this bias circuit 10 comprises four n-channel Metal-Oxide-Semiconductor Field-Effect Transistors (MOSFETs) M11, M12, M13, and M14 and a resistor R11.

Each of the MOSFETs M11 and M14 has a so-called diode connection. Thus, the gate and the drain of the MOSFET M11 are coupled together at the point P1 and the gate and the drain of the MOSFET 14 are coupled together at the point P2. The drain of the MOSFET M11 is connected to the terminal T1 by way of the resistor R11 while the gate of the MOSFET M11 is connected to the gate of the MOSFET M13. The source of the MOSFET M11 is connected to the drain of the MOSFET M12. The gate and the source of the MOSFET M12 are connected to the gate and the source of the MOSFET M14, respectively. The coupled sources of the MOSFETs M12 and M14 are connected to the ground. Thus, the MOSFETs M11 and M12 located at the input side are connected in cascode.

The drain and the source of the MOSFET M13 are connected to the terminal T2 and the drain of the MOSFET M14, respectively. The output terminal T3 of the active bias circuit 10 is connected to the point P2 at which the gate and the drain of the MOSFET M14 are coupled together. Thus, the MOSFETs M13 and M14 located at the output side also are connected in cascode.

A reference voltage $V_1$ is applied to the terminal T1, thereby generating a reference current $I_{REF}$ flowing through the reference resistor R11. In other words, the reference current $I_{REF}$ is generated by the reference voltage $V_1$ and the reference resistor R11. Since it can be considered that no gate current flows to the gates of the MOSFETs M11 and M13, the reference current $I_{REF}$ is equal to the drain current $I_{D11}$ of the MOSFET M11 and to the drain current $I_{D12}$ of the MOSFET M12 (i.e., $I_{REF}=I_{D11}=I_{D12}$).

A bias voltage $V_2$ is applied to the terminal T2, thereby generating the drain current $I_{D13}$ of the MOSFET M13. The value of the drain current $I_{D13}$ has a specific ratio with respect to that of the reference current $I_{REF}$. Specifically, the value of the drain current $I_{D13}$ is a times as much as that of the reference current $I_{REF}$, where a is a positive constant (i.e., $I_{D13}=aI_{REF}$). Since it can be considered that no gate current flows to the gates of the MESFETs M12 and M14, the drain current $I_{D13}$ is equal to the drain current $I_{D14}$ of the MOSFET M14 (i.e., $I_{D13}=I_{D14}$).

The output bias voltage $V_{OUT}$ of the conventional bias circuit 10 is generated at the output terminal T3. The output bias voltage $V_{OUT}$ is equal to the voltage at the connection point P2 of the gate and the drain of the MOSFET M14 (i.e., the connection point of the drain of the MOSFET M14 and the source of the MOSFET M13).

A target circuit 20, to which the output bias voltage $V_{OUT}$ is applied from the active bias circuit 10, includes an n-channel enhancement MOSFET M15. The gate of the MOSFET M15 is connected to the output terminal T3 of the circuit 10, receiving the bias voltage $V_{OUT}$ of the circuit 10. The drain of the MOSFET M15 is connected to the terminal T4 to which a voltage $V_D$ is applied. The source of the MOSFET M15 is connected to the ground. Accordingly, the gate-to-source voltage of the MOSFET M15 is equal to the output bias voltage $V_{OUT}$, which means that the drain current $I_{D15}$ of the MOSFET M15 of the target circuit 20 increases or decreases according to the output bias voltage $V_{out}$ of the bias circuit 10.

Although the target circuit 20 includes other active elements and passive elements along with the MOSFET M15, they are omitted in FIG. 1 for the sake of simplification.

The conventional active bias circuit 10 of FIG. 1 operates in the following way.

If the value of the reference resistor R11 is suitably determined or adjusted according to the value of the reference voltage $V_1$ (e.g., 2V) applied to the terminal T1, the value of the reference current $I_{REF}$ flowing through the MOSFET M11 can be set as desired. Also, due to the reference current $I_{REF}$ thus set, the value of the voltage $V_{P1}$ at the connection point P1 (i.e., the connection point of the resistor R11 and the drain of the MOSFET M11) is determined. In this case, the value of the voltage $V_{p2}$ at the connection point P2 (i.e., the output terminal T3) is given as the difference of the value of the forward voltage drop $V_{FM13}$ of the MOSFET M13 from that of the bias voltage $V_2$ applied to the terminal T2. Thus, the following equation (1) is established.

$$V_{P2}=K_{OUT}=V_2-V_{FM13} \quad (1)$$

When the value of the reference voltage $V_{REF}$ applied to the terminal T1 (i.e., the reference current $I_{REF}$) is changed, the values of the drain current $I_{D13}$ of the MOSFET M13 and the forward voltage drop $V_{FM13}$ thereof are changed, resulting in change of the output bias voltage $V_{OUT}$. This means that even if the bias voltage $V_2$ is not changed, the output bias voltage $V_{OUT}$ can be changed by changing the reference voltage $V_1$.

In the target circuit 20, the value of the drain current $I_{D15}$ of the MOSFET M15 varies according to the value of the output bias voltage $V_{OUT}$ applied to the gate of the MOSFET M15. Since the MOSFET M15 is of the enhancement type, the value of the drain current $I_{D15}$ of the MOSFET M15 can be set as zero (i.e., 0 V) if the value of the output bias voltage $V_{OUT}$ is set to be lower than the threshold voltage of the MOSFET M15. Thus, the MOSFET M15 can be cut off.

The operation of the conventional bias circuit 10 shown in FIG. 1 scarcely fluctuates even if the threshold voltages $V_{th}$ of the MOSFETs M11, M12, M13, and M14 fluctuate due to change of the various parameters in their fabrication process sequence and/or change of the ambient temperature of the circuit 10 during operation. In other words, as long as the parameters of the circuit 10 are kept unchanged, the value of the drain current $ID^{D15}$ of the MOSFET M15 in the target circuit 20 is kept approximately constant in spite of the fluctuation of the threshold voltage and the ambient temperature.

For example, when the absolute values (i.e., amplitude) of the threshold voltages $V_{th}$ of the MOSFETs M11, M12, M13, and M14 decrease, the value of the reference Current $I_{REF}$ increases according to the decrease of the threshold voltages $V_{th}$, lowering the voltage $V_{P1}$ at the point P1 On the other hand, according to the increase of the reference current $I_{REF}$, the drain current $I_{D13}$ of the MOSFET M13 increases, which increases the voltage drop generated by the MOSFET M13. As a result, the value of the voltage $V_{P2}$ at the point P2 (i.e., the output bias voltage $V_{OUT}$ of the circuit 10) decreases.

On the contrary, when the absolute values (i.e., amplitude) of the threshold voltages $V_{th}$ of the MOSFETs M11, M12, M13, and M14 increase, the value of the reference current $I_{REF}$ decreases according to the increase of the threshold voltages $V_{th}$, raising the voltage $V_{P1}$ at the point P1. On the other hand, according to the decrease of the reference current $I_{REF}$, the drain current $I_{D13}$ of the MOSFET M13 decreases, which decreases the voltage drop generated by the MOSFET M13. As a result, the value of the voltage $V_{P2}$ at the point P2 (i.e., the output bias voltage $V_{OUT}$) increases.

With the conventional bias circuit 10, in the above-described manner, the drain currents $I_{D13}$ and $I_{D14}$ Of the MOSFETs M13 and M14 (and therefore, the drain current $I_{D15}$ of the MOSFET M15) are kept approximately constant against the fluctuation of the threshold voltages $V_{th}$, The bias circuit 10 operates in the same way as above when the ambient temperature varies as well. Therefore, the drain current $I_{D15}$ of the MOSFET M15 is kept approximately constant against the fluctuation of the ambient temperature.

However, the above-described conventional active bias circuit 10 shown in FIG. 1 has the following problems.

Specifically, with the conventional circuit 10, the power consumption of the target circuit 20 (i.e., the MOSFET M15) can be adjusted by changing the value of the reference voltage $V_1$ applied to the terminal T1. This is due to the fact that the output bias voltage $V_{OUT}$ varies according to the change of the reference voltage $V_1$, which changes the drain current $I_{D15}$ of the MOSFET M15.

The bias circuit 10 is used, for example, for applying a desired bias voltage to a Radio-Frequency (RF) amplifier circuit provided in a mobile telephone or a cellular phone. In this case, the target circuit 20 is the RF amplifier circuit.

With mobile or cellular phones, generally, the voltage $V_D$ is supplied to the MOSFET M15 by way of the terminal T4 in the target circuit 20 and at the same time, the output bias voltage $V_{OUT}$ with a desired value is supplied by the bias circuit 10 to the MOSFET M15 of the target circuit 20 (i.e,, the RF amplifier circuit) in the normal operation. On the other hand, in the power-saving operation, the supply of the voltage $V_D$ to the MOSFET M15 is stopped with a switch (e.g., a so-called drain switch, not shown in FIG. 1) to stop temporarily the operation of the MOSFET M15 (and the circuit 20 itself).

Thus, there is a problem that the count (i.e., total number) of the necessary parts increases because the drain switch is essentially provided. Also, there is another problem that the switch necessitates specific electric power.

If the drain switch can be eliminated, these two problems are easily solved. This is realized by, for example, setting the output bias voltage $V_{OUT}$ of the bias circuit 10 to be lower than the threshold voltage of the MOSFET M15, thereby stopping the operation of the MOSFET 15 (i.e., the operation of the target circuit 20). However, some mobile telephones have a configuration that does not permit the reference voltage $V_1$ of 0 V. In this case, it is unable to set the output bias voltage $V_{OUT}$ of the bias circuit 10 to be lower than the threshold voltage of the MOSFET M15, making the MOSFET M15 cut off. This means that there arises a problem that the lifetime or duration of the battery tends to be shortened.

Moreover, since the output bias voltage $V_{OUT}$ of the bias circuit 10 is unable to be sufficiently low, it is impossible or difficult for the MOSFET M15 to generate a sufficiently low RF output as desired. In other words, there is a problem that the variable range of the RF output of the MOSFET M15 by the reference voltage $V_1$ is narrow.

SUMMARY OF THE INVENTION

Accordingly, an object of the present invention is to provide an active bias circuit that makes it possible to set the output bias voltage at approximately zero (0V) even if a reference voltage applied to generate a reference current does not reach the value of zero.

Another object of the present invention is to provide an active bias circuit that expands the variable range of the RF output of a target circuit that varies by changing the value of a reference voltage.

Still another object of the present invention is to provide an active bias circuit that makes it possible to cut off a current flowing in a target circuit including an enhancement active element or device without providing any cut-off switch.

The above objects together with others not specifically mentioned will become clear to those skilled in the art from the following description.

According to a first aspect of the present invention, an active bias circuit is provided, which comprises:

(a) a first transistor with a diode connection;
  the first transistor being supplied with a reference current by way of a first resistor;
  the first transistor having a control terminal;

(b) a second transistor connected in cascode to the first transistor;
  the second transistor having a control terminal;

(c) a third transistor having a control terminal connected to the control terminal of the first transistor;
  a constant current with a specific ratio with respect to the reference current flowing through the third transistor;

(d) a fourth transistor with a diode connection;
  the fourth transistor being connected in cascode to the third transistor;
  the fourth transistor having a control terminal connected to the control terminal of the second transistor;

(e) an output terminal formed between the third and fourth transistors connected in cascode;
  an output bias voltage being derived from the output terminal;
  the output bias voltage varying according to a reference voltage applied across the first and second transistors connected in cascode; and (f) a second resistor connected between the control terminal of the first transistor and the control terminal of the third transistor;
  wherein an absolute value of the output bias voltage is decreased with a voltage drop of the second resistor that is generated by a current flowing through the second resistor.

With the active bias circuit according to the first aspect of the present invention, the second resistor is provided between the control terminal of the first transistor and the control terminal of the third transistor. When a current flows through the second resistor, a specific voltage drop occurs. Therefore, by utilizing the voltage drop thus caused by the second resistor, the absolute value of the output bias voltage is decreased.

For example, when each of the first and third transistors is a FET, its control terminal is a gate. In this case, a leakage current flows through the second resistor between the gates of the two FETs (i.e., the first and third transistors) and therefore, a voltage drop is caused by the second resistor according to the value of the leakage current. On the other hand, when each of the first and third transistors is a bipolar transistor, its control terminal is a base. In this case, a base current flows through the second resistor between the bases of the two bipolar transistors and therefore, a voltage drop is caused by the second resistor according to the value of the base current. Consequently, the absolute value of the output bias voltage is decreased according to the value of the voltage drop thus caused.

As a result, even if the reference voltage applied to generate the reference current does not reach the value of zero (i.e., 0 V), the absolute value (i.e., amplitude) of the output bias voltage can be set at approximately zero. Thus, the current flowing through a target circuit, which is supplied with the output bias voltage from the active bias circuit of the first aspect, can be cut off without any dedicated switch for current cut-off.

Also, the absolute value of the output bias voltage is decreased according to that of the voltage drop of the second resistor. Therefore, the variable range of power consumption of the target circuit that varies by changing the value of the reference voltage can be expanded toward the low-value side. This means that the variable range of the REF output of the target circuit, which varies by changing the value of the reference voltage, is expanded.

In addition, the second resistor is connected between the control terminals of the first and third transistors. Therefore, the operation of the active bias circuit (i.e., the stable supply operation of the bias voltage) is not affected by insertion of the second resistor.

In a preferred embodiment of the circuit according to the first aspect, the absolute value of the output bias voltage reaches 0 V before the absolute value of the reference voltage reaches 0 V from a specific value.

In another preferred embodiment of the circuit according to the first aspect, the active bias circuit is so designed that the output bias voltage is applied to a control terminal of a voltage-driven active element operable in an enhanced mode provided in a target circuit. The absolute valve of the output bias voltage reaches a value for cutting off the element in the target circuit before the absolute value of the reference voltage reaches 0 V from a specific value.

According to a second aspect of the present invention, another active bias circuit is provided, which comprises:

(a) a first transistor with a diode connection;
the first transistor being supplied with a reference current by way of a first resistor;
the first transistor having a control terminal;

(b) a second transistor connected in cascode to the first transistor;
the second transistor having a control terminal;

(c) a third transistor having a control terminal connected to the control terminal of the first transistor;
a constant current with a specific ratio with respect to the reference current flowing through the third transistor;

(d) a fourth transistor with a diode connection;
the fourth transistor being connected in cascode to the third transistor;
the fourth transistor having a control terminal connected to the control terminal of the second transistor;

(e) an output terminal formed between the third and fourth transistors connected in cascode;
an output bias voltage being derived from the output terminal;
the output bias voltage varying according to a reference voltage applied across the first and second transistors connected in cascode; and (f) a second resistor having a terminal connected to the control terminals of the second transistor and the fourth transistor in such a way that part of the current flowing through the third transistor flows through the second resistor to decrease a current flowing through the fourth transistor, thereby decreasing a voltage drop of the fourth transistor;
wherein an absolute value of the output bias voltage is decreased according to decrease of the voltage drop of the fourth transistor.

With the active bias circuit according to the second aspect of the present invention, the terminal of the second resistor is connected to the control terminals of the second transistor and the fourth transistor in such a way that part of the current flowing through the third transistor is shunted to the second resistor to decrease a current flowing through the fourth transistor, thereby decreasing the voltage drop of the fourth transistor. The absolute value of the output bias voltage is decreased according to decrease of the voltage drop of the fourth transistor.

As a result, even if the reference voltage applied to generate the reference current does not reach the value of zero (i.e., 0 V), the absolute value (i.e., amplitude) of the output bias voltage can be set at approximately zero. Thus, the current flowing through a target circuit, which is supplied with the output bias voltage from the active bias circuit of the second aspect, can be cut off without any dedicated switch for current cut-off.

Also, the absolute value of the output bias voltage is decreased according to the decrease of the voltage drop of the fourth transistor. Therefore, the variable range of power consumption of the target circuit that varies by changing the value of the reference voltage can be expanded toward the low-value side. This means that the variable range of the RF output of the target circuit, which varies by changing the value of the reference voltage, is expanded.

In addition, the second resistor has the terminal connected in common to the control terminals of the second and fourth transistors and then, the part of the current flowing through the third transistor is shunted to the second resistor. Therefore, the operation of the active bias circuit (i.e., the stable supply operation of the bias voltage) is not affected by insertion of the second resistor.

In a preferred embodiment of the circuit according to the second aspect, the second resistor has a resistance less than that of the fourth transistor. In this embodiment, a larger part of the current flowing through the third transistor is shunted to the second resistor, resulting in a large decrease of the voltage drop of the fourth transistor.

In another preferred embodiment of the circuit according to the second aspect, the absolute value of the output bias voltage reaches 0 V before the absolute value of the reference voltage reaches 0 V from a specific value.

In still another preferred embodiment of the circuit according to the second aspect, the active bias circuit is so designed that the output bias voltage is applied to a control terminal of a voltage-driven active element operable in an enhanced mode provided in a target circuit. The absolute value of the output bias voltage reaches a value for cutting off the element in the target circuit before the absolute value of the reference voltage reaches 0 V from a specific value.

BRIEF DESCRIPTION OF THE DRAWINGS

In order that the present invention may be readily carried into effect, it will now be described with reference to the accompanying drawings.

DETAILED DESCRIPTION OF THE PREFERRED EMBODIMENTS

Figure 1:
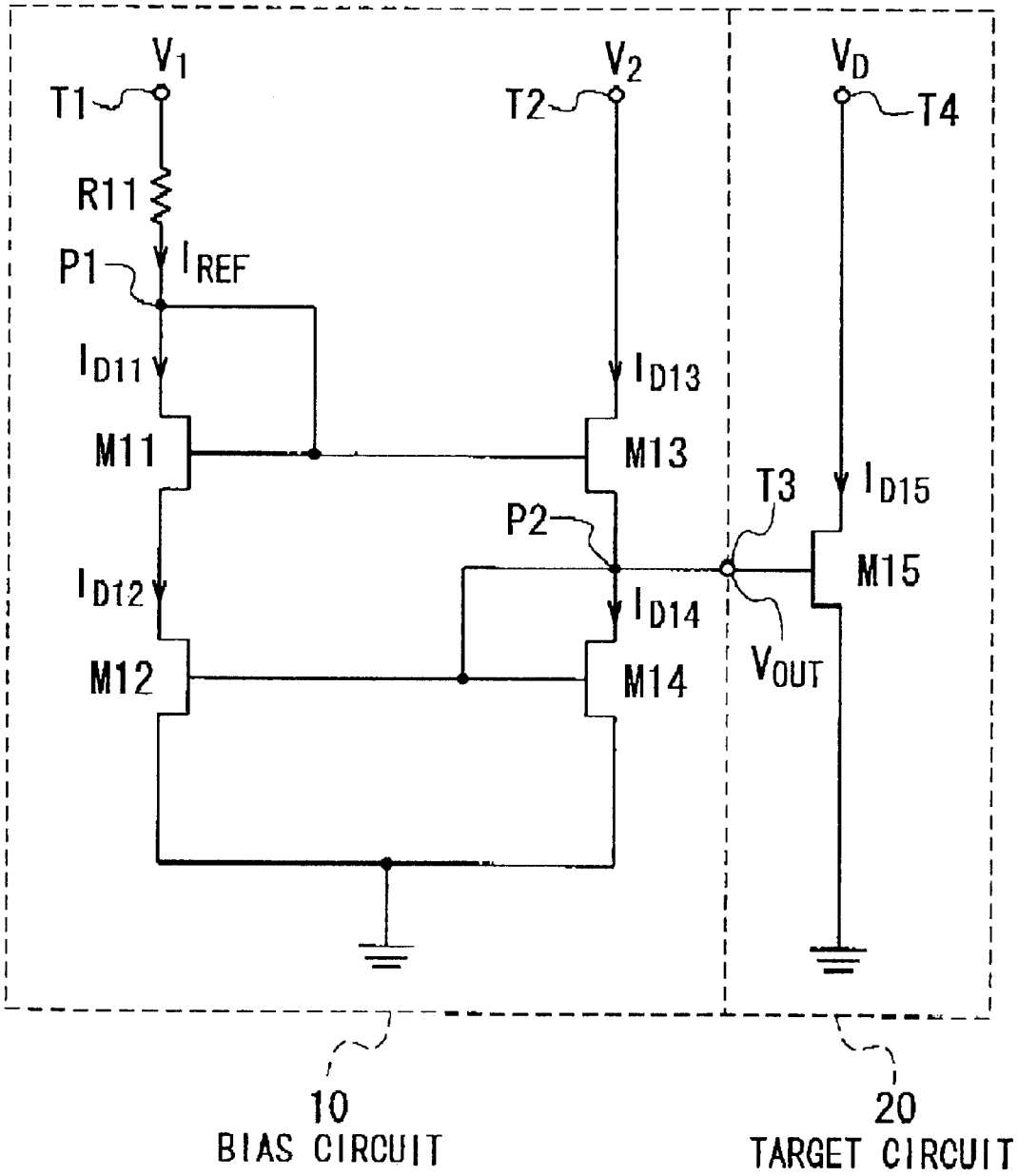
FIG. 1 PRIOR ART
FIG. 1 is a circuit diagram showing the configuration of a conventional active bias circuit of this type.

Preferred embodiments of the present invention will be described in detail below while referring to the drawings attached

First Embodiment

Figure 2:
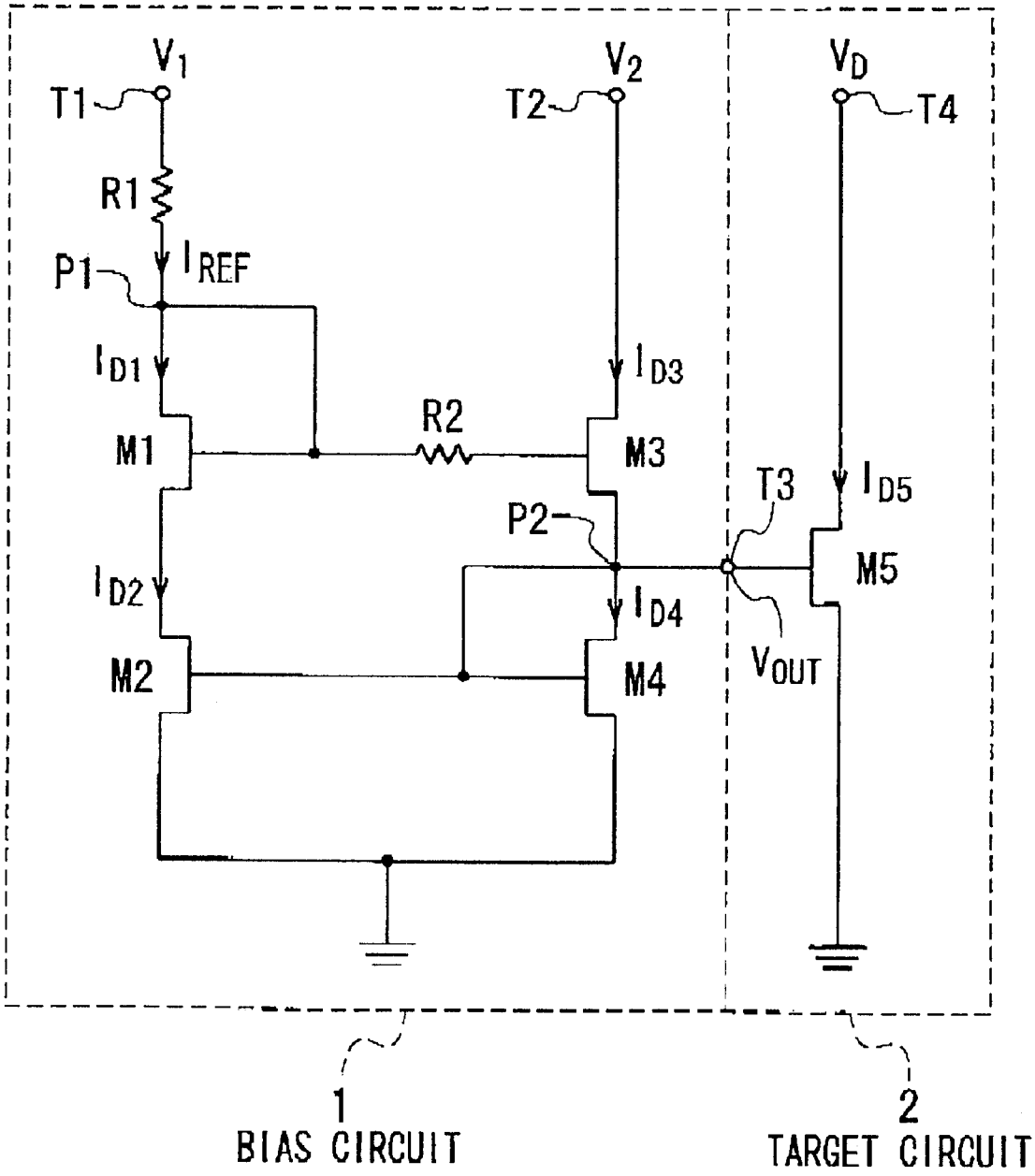
FIG. 2 is a circuit diagram showing the configuration of an active bias circuit according to a first embodiment of the invention.

As shown in FIG. 2, an active bias circuit 1 according to a first embodiment of the invention has a combined configuration of the Wilson and Widlar current source configurations. This bias circuit 1 comprises four n-channel MOSFETs M1, M2, M3, and M4, a resistor R1, and a resistor R2, The resistor R1 serves to generate a reference current $I_{REF}$. The resistor R2 serves to lower the gate voltage of the MOSFET M3 to be lower than the gate voltage of the MOSFET M1.

Each of the MOSFETs M1 and M4 has a so-called diode connection. Thus, the gate and the drain of the MOSFET M1 are coupled together at the point P1 and the gate and the drain of the MOSFET M4 are coupled together at the point P2. The drain of the MOSFET M1 is connected to the terminal T1 by way of the resistor R1 while the gate of the MOSFET M1 is connected to the gate of the MOSFET M3 by way of the resistor R2. The source of the MOSFET M1 is connected to the drain of the MOSFET M2. The gate and the source of the MOSFET M2 are connected to the gate and the source of the MOSFET M4 respectively. The coupled sources of the MOSFETs M2 and M4 are connected to the ground. Thus, the MOSFETs M1 and M2 located at the input side are connected in cascode. Here, the resistor R2 has a resistance of 1 kΩ.

The drain of the MOSFET M3 is connected to the terminal T2. The source of the MOSFET M3 is connected to the drain of the MOSFET M4 at the connection point P2. The gate and drain of the MOSFET M4 are coupled together at the point P2, The output terminal T3 of the active bias circuit 1 is connected to the point P2. Thus, the MOSFETs M3 and M4 located at the output side also are connected in cascode.

A reference voltage $V_1$ is applied to the terminal T1, which is connected to the drain of the MOSFET M1 by way of the resistor R1, thereby generating a reference current $I_{REF}$ flowing through the resistor R1. In other words, the reference current 1 is generated by the reference voltage $V_1$ and the reference resistor R1. Since it can be considered that no gate current flows to the gates of the MOSFETs M1 and M2, the reference current $I_{REF}$ is equal to the drain current $I_{D1}$ of the MOSFET M1 and to the drain current $I_{D2}$ of the MOSFET M2 (i.e., $I_{REF}=I_{D1}=I_{D2}$).

A bias voltage $V_2$ is applied to the terminal T2, which is connected to the drain of the MOSFET M2, thereby generating the drain current $I_{D3}$ of the MOSFET M3. The value of the drain current $I_{D3}$ has a specific ratio with respect to that of the reference current $I_{REF}$. Specifically, the value of the drain current $I_{D3}$ is a times as much as that of the reference current $I_{REF}$, where a is a positive constant (i.e., $I_{D3}=aI_{REF}$). Since it can be considered that no gate current flows to the gates of the MOSFETs M3 and M4, the drain current $I_{D3}$ is equal to the drain current $I_{D4}$ of the MOSFET M4 (i.e., $I_{D3}=I_{D4}$).

The output bias voltage $V_{OUT}$ of the bias circuit 1 is generated at the output terminal T3. The output bias voltage $V_{OUT}$ is equal to the voltage $V_{P2}$ at the connection point P2 of the gate and the drain of the MOSFET M4.

A target circuit 2, to which the output bias voltage $V_{OUT}$ is applied from the active bias circuit 1, includes an n-channel enhancement MOSFET M5. The gate of the MOSFET M5 is connected to the output terminal T3 of the bias circuit 1, receiving the bias voltage $V_{OUT}$ of the circuit 1. The drain of the MOSFET M5 is connected to the terminal T4 to which a voltage $V_D$ is applied. The source of the MOSFET M5 is connected to the ground. Thus, the gate-to-source voltage of the MOSFET M5 is equal to the output bias voltage $V_{OUT}$ of the circuit 1 and as a result, the drain current $I_{D5}$ of the MOSFET M5 increases or decreases according to the value of the output bias voltage $V_{OUT}$.

Although the target circuit 2 includes other active elements and passive elements along with the MOSFET M5, they are omitted in FIG. 2 for the sake of simplification.

The active bias circuit 1 according to the first embodiment of FIG. 2 operates in the following way.

If the resistance value of the reference resistor R1 is suitably determined or adjusted according to the specific value of the reference voltage $V_1$ (e.g., 2V), the value of the reference current $I_{REF}$ flowing through the MOSFET M1 can be set as desired. Also, due to the reference current $I_{RE}$ thus set, the value of the voltage $V_{P1}$ at the connection point P1 (i.e., the connection point of the resistor R1 and the drain of the MOSFET M1) is determined. In this case, the resistor R2 is connected between the gate of the MOSFET M1 and the gate of the MOSFET M3 and therefore, a leakage current flows from the gate of the MOSFET M1 to the gate of the MOSFET M3 through the resistor R2, resulting in a voltage drop $V_R$. Thus, the gate voltage of the MOSFET M3 is lower than the gate voltage of the MOSFET M1 by the voltage drop $V_R$ caused by the leakage current. As a result, the value of the voltage $V_{P2}$ at the connection point P2 (i.e, the output bias voltage $V_{OUT}$ at the output terminal T3) is lower than that of the conventional active bias circuit 10 (which is given by the above-identified equation (1)) by the voltage drop $V_R$. This means that the following equation (2) is established, $$V_{OUT}=V_{P2}=V_2-V_{FM3}-V_R \quad (2)$$

where $V_{FM3}$ is the forward voltage drop of the MOSFET M3.

Accordingly, when the value of the reference voltage $V_{REF}$ applied to the terminal T1 (i.e., the reference current $I_{REF}$) is changed, the values of the drain current $I_{D3}$ of the MOSFET M3 and the forward voltage drop $V_{FM3}$ thereof are changed, resulting in change of the output bias voltage $V_{OUT}$. This means that even if the bias voltage $V_2$ is not changed, the output bias voltage $V_{OUT}$ can be changed by changing the reference voltage $V_1$.

The value of the drain current $I_{D5}$ of the MOSFET M5 in the target circuit 2 varies according to the value of the output bias voltage $V_{OUT}$ applied to the gate of the MOSFET M5. Since the MOSFET M5 is of the enhancement type, the value of the drain current $I_{D5}$ of the MOSFET M5 can be set as zero (i.e., 0 A) if the value of the output bias voltage $V_{OUT}$ is set to be lower than the threshold voltage of the MOSFET M5 In other words, if the value of the output bias voltage $V_{OUT}$ is set at approximately 0V the MOSFET M5 can be cut off.

In the active bias circuit 1 according to the first embodiment shown in FIG. 2, the resistor R2 gives no effect to the operation of the circuit 1. Therefore, like the conventional active bias circuit 10 shown in FIG. 1, the bias circuit 1 operates stably even if the threshold voltages $V_{th}$ of the MOSFETs M1, M2, M3, and M4 fluctuate due to change of the various parameters in their fabrication process sequence and/or the ambient temperature of the circuit 1 varies during operation. In other words, as long as the parameters of the circuit 1 are kept unchanged, the value of the drain current $I_{D5}$ of the MOSFET M5 is kept approximately constant in spite of the fluctuation of the threshold voltage and the ambient temperature. This is the same as the conventional circuit 10 of FIG. 1 and thus, no detailed explanation is omitted here.

As described above, with the active bias circuit 1 according to the first embodiment of FIG. 2, the resistor R2 with the forward voltage drop $V_R$ caused by the leakage current is provided between the gates of the MOSFETs M1 and M3. Therefore, the absolute value (i.e., amplitude) of the output bias voltage $V_{OUT}$, which is varied by the reference voltage $V_{REF}$ applied across the cascode-connected MOSFETs M1 and M5, is decreased by the value of the voltage drop $V_R$ of the resistor R2, compared with the conventional bias circuit 10 of FIG. 1.

Consequently, even if the reference voltage $V_{REF}$ applied to generate the reference current $I_{REF}$ does not reach 0 V the absolute value of the output bias voltage $V_{OUT}$ can be set at approximately 0 V. Thus, the drain current $I_{D5}$ flowing through the MOSFET M5 in the target circuit 2 can be cut off without any dedicated switch (i.e., drain switch) for current cut-off.

Also, the lowest value of the output bias voltage $V_{OUT}$ is smaller than that of the conventional circuit 10 by the value of the voltage drop $V_R$ of the resistor R2. Therefore, the variable range of RF output of the target circuit 2 that varies by changing the value of the reference voltage $V_1$ can be expanded toward the low-value side.

A concrete example of the bias circuit 1 is as follows, which was confirmed by the inventor's test.

When the reference voltage $V_1$ is set at 2V and at the same time, the bias voltage $V_2$ and the voltage $V_D$ for the MOSFET M5 are set at 4V (i.e., $V_1$=2V, $V_2$=$V_D$=4V), the output bias voltage $V_{OUT}$ at the terminal T3 is approximately 0.5V. This means that a desired bias voltage is applied to the MOSFET M5 of the target circuit 2. Thus, the MOSFET M5 is capable of its specific RF amplification function well.

When only the reference voltage $V_1$ is decreased to 0.2V from 2V (i.e., $V_1$=0.2V, $V_2$=$V_D$=4V), the output bias voltage $V_{OUT}$ is lowered to approximately 0.02V in the circuit 1 of the first embodiment due to the voltage drop $V_R$ of the resistor R2. Unlike this, the output bias voltage $V_{OUT}$ is lowered to approximately 0.1V in the conventional circuit 10 of FIG. 1. As a consequence, even is if the reference voltage $V_1$ is not lowered to 0V, the output bias voltage $V_{OUT}$ can be lowered to approximately 0V.

For example, the threshold voltage of the MOSFET M5 of the target circuit 2 is approximately 0.15V. Thus, when the reference voltage $V_{REF}$ is lowered to approximately 0.2V, the drain current $I_{D5}$ of the MOSFET M5 is decreased to 0A, which ensures cutting off of the MOSFET M5.

Second Embodiment

Figure 3:
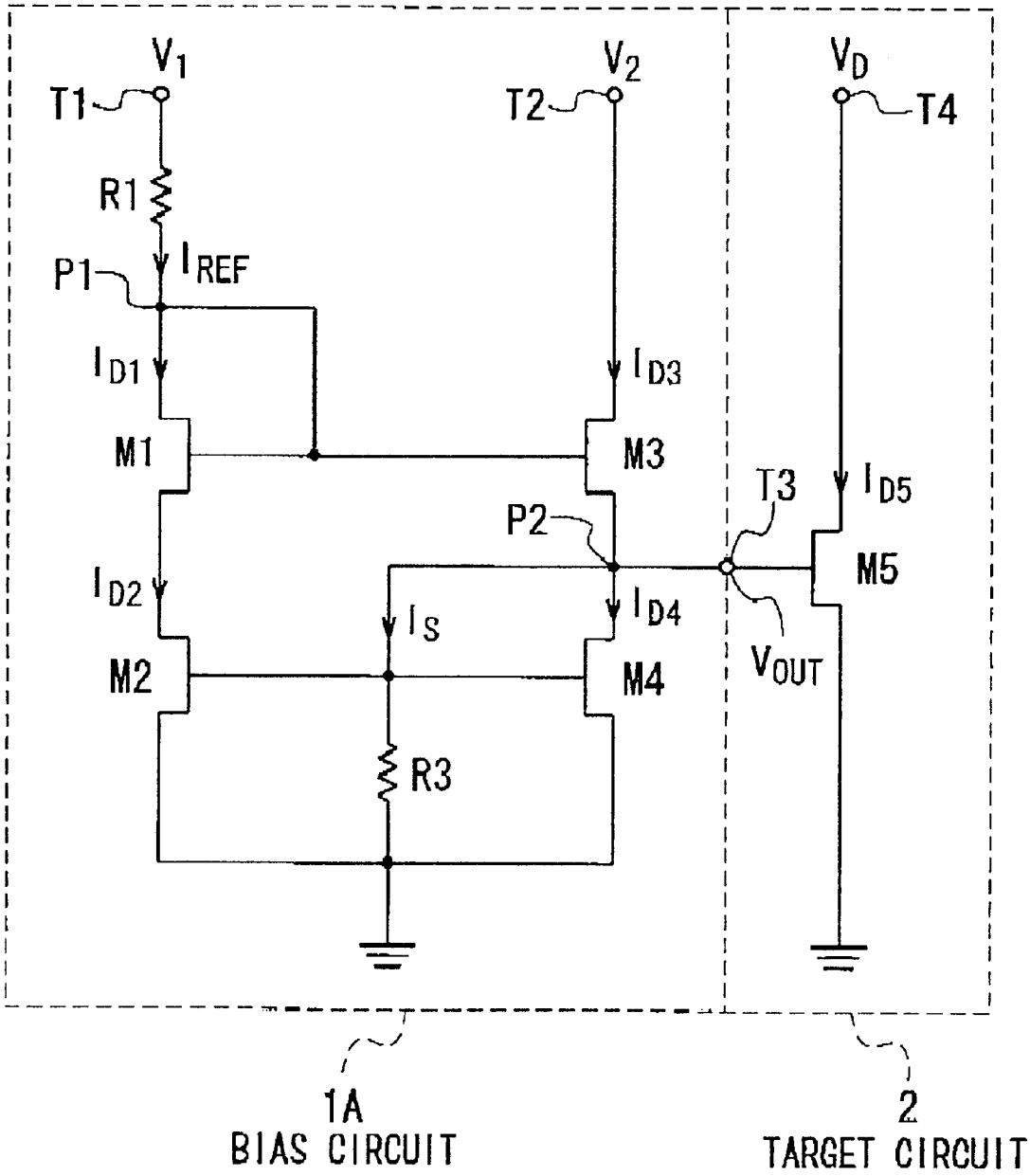
FIG. 3 is a circuit diagram showing the configuration of an active bias circuit according to a second embodiment of the invention.

FIG. 3 shows an active bias circuit 1A according to a second embodiment of the invention, which comprises the same configuration as the circuit 1 according to the first embodiment of FIG. 2, except that a resistor R3 for shunting the drain current of the MOSFET M4 is provided instead of the resistor R2 for generating the voltage drop $V_R$. Therefore, the description about the same configuration is omitted here by attaching the same reference symbols as those in the first embodiment of FIG. 2 for the sake of simplification of description in FIG. 3.

As shown in FIG. 3, the resistor R3 is connected across the gate and the source of the MOSFET M4 As already explained above, the gate of the MOSFET M4 is coupled with the drain thereof. Thus, it is said that the resistor R3 is connected in parallel to the MOSFET M4 between its drain and source.

It is preferred that the resistance value of the resistor R3 is smaller than that of the drain-to-source resistance $R_{M4}$ of the MOSFET M4 which is measured without the addition of the resistor R3. This is to cause the majority of the drain current $I_{D3}$ of the MOSFET M3 to flow through the resistor R3, thereby decreasing largely the drain current $I_{D4}$ of the MOSFET M4 compared with the case where the resistor R3 is not inserted. Thus, the forward voltage drop $V_{FM4}$ of the MOSFET M4 caused by the drain current $I_{D4}$ has a sufficiently small value as desired. As a result, the output bias voltage $V_{OUT}$ can be easily reduced to a desired value or amplitude. Here, the resistor R3 has a resistance of 1 kΩ.

The operation of the active bias circuit 1A according to the second embodiment of FIG. 3 is as follows.

If the value of the reference resistor R1 is suitably determined or adjusted according to the specific value of the reference voltage $V_1$ (e.g., 2V), the value of the reference current $I_{REF}$ flowing through the MOSFET M1 can be set as desired. Also, due to the reference current $I_{RE}$ thus set, the value of the voltage $V_{P1}$ at the connection point P1 is determined. In this case, the value of the voltage $V_{P2}$ at the connection point P2 is given as the forward voltage drop $V_{FM4}$ of the MOSFET M4. Thus, the following equation (3) is established.

$$V_{OUT}=V_{P2}=V_{FM4} \tag{3}$$

Also, in the bias circuit 1A, the resistor R3 is inserted to be parallel to the MOSFET M4 and therefore, the large part of the drain current $I_{D3}$ Of the MOSFET M3 is shunted to the resistor R3 to the ground while the remainder of the current $I_{D3}$ flows through the MOSFET M4 to the ground. Accordingly, the following equation (4) is established, where $I_s$ is the shunt current flowing through the resistor R3.

$$I_{D4}=I_{D3}-I_S \tag{4}$$

In the conventional active bias circuit 10 shown in FIG. 1, the drain current $I_{D4}$ of the MOSFET M4 is equal to the drain current $I_{D3}$ of the MOSFET M3 if the gate currents of the MOSFETs M3 and M3 are ignored, i.e. $I^{D4}$=$I_{D3}$. On the contrary, in the active bias circuit 1A of the second embodiment, as seen from the equation (4), the drain current $I_{D4}$ of the MOSFET M4 is decreased by the shunt current $I_S$.

Thus, the value of the drain-to-source resistance $R_{FM4}$ of the MOSFET M4 is reduced according to the value of the shunt current $I_S$. In other words, the value of the forward voltage drop $V_{F4}$ of the MOSFET M4 is reduced. As a result, as seen from the equation (3), the output bias voltage $V_{OUT}$ of the circuit 1A is decreased to be lower than that of the conventional circuit 10 by the forward voltage drop $V_{M4}$ of the MOSFET M4.

As explained above, with the active bias circuit 1A of the second embodiment as well, like the circuit 1 of the first embodiment, even if the reference voltage $V_{REF}$ applied to generate the reference current $I_{REF}$ does not reach 0 V, the absolute value of the output bias voltage $V_{OUT}$ can be set at approximately 0 V. Thus, the drain current $I_{D5}$ flowing through the MOSFET M5 in the target circuit 2 can be cut off without any dedicated switch (i.e., drain switch) for current cut-off, Also, the lowest value of the output bias voltage $V_{OUT}$ is lower than that of the conventional circuit 10 according to the decrease of the voltage drop $V_{FM4}$ of the MOSFET M4. Therefore, the variable range of RF output of the target circuit 2 that varies by changing the value of the reference voltage $V_1$ can be expanded toward the low-value side.

A concrete example of the bias circuit 1A of the second embodiment is as follows, which was confirmed by the inventor's test as well.

When the reference voltage $V_1$ is set at 2V and at the same time, the bias voltage $V_2$ and the voltage $V_D$ for the MOSFET M5 are set at 4V (i.e., $V_1$=2V, $V_2$=$V_D$=4V), the output bias voltage $V_{OUT}$ at the terminal T3 is approximately 0.V. This means that a desired bias voltage is applied to the MOSFET M5 of the target circuit 2. Thus, the MOSFET M5 is capable of its specific RF amplification function well.

When only the reference voltage $V_1$ is decreased to 0.2V from 2V (i.e., $V_1$=0.2$V_2$=$V_D$=4V), the output bias voltage $V_{OUT}$ is lowered to approximately 0.02V in the circuit 1A of the second embodiment due to the decrease of the forward voltage drop $V_{FM4}$ of the MOSFET M4. As a consequence, even if the reference voltage $V_1$ is not lowered to 0V, the output bias voltage $V_{OUT}$ can be lowered to approximately 0V. For example, when the reference voltage $V_{REF}$ is lowered to approximately 0.2V, the drain current $I_{D5}$ of the MOSFET M5 is decreased to 0A, which ensures cutting off of the MOSFET M5.

Third Embodiment

Figure 4:
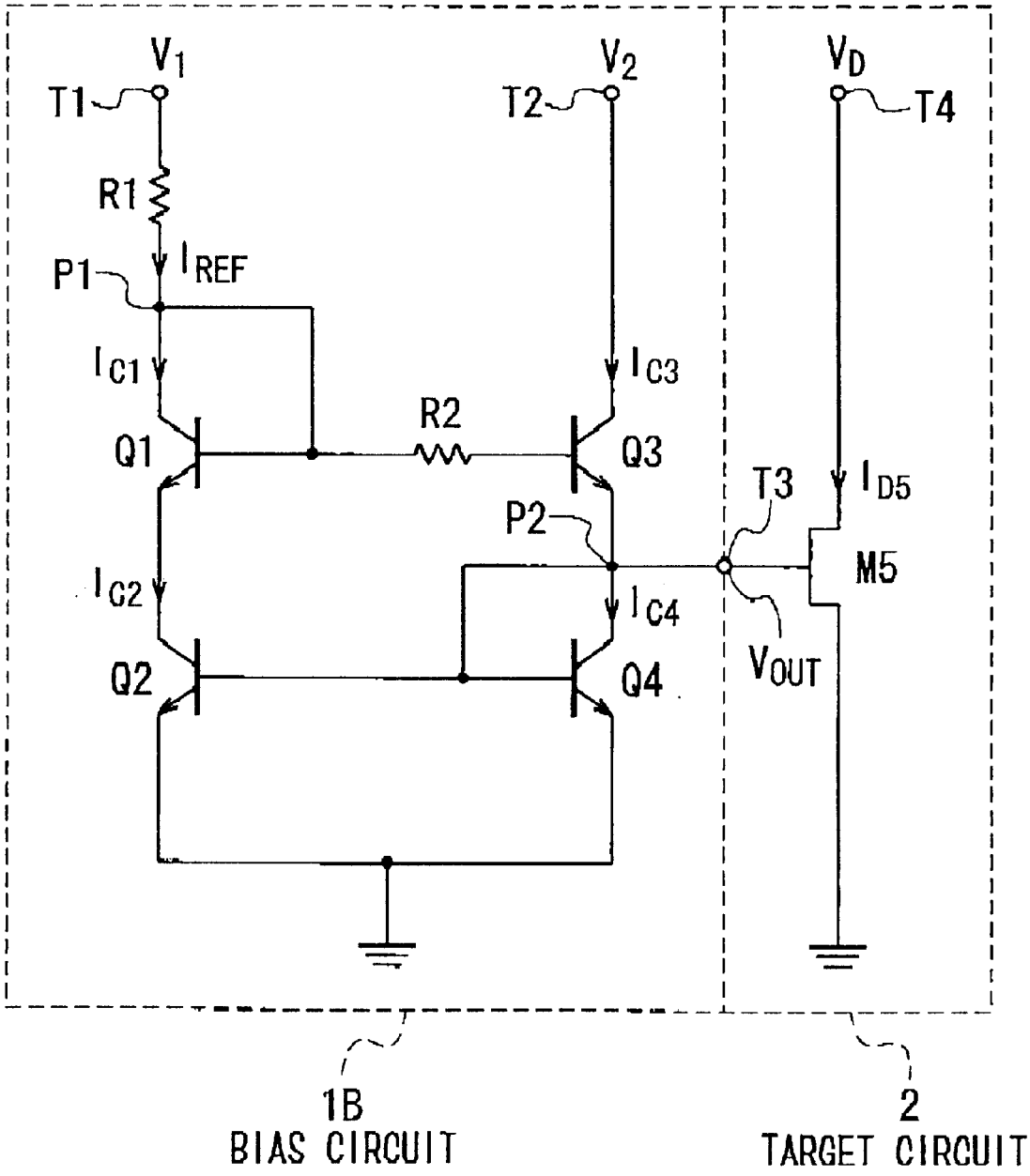
FIG. 4 is a circuit diagram showing the configuration of an active bias circuit according to a third embodiment of the invention.

FIG. 4 shows an active bias circuit 1B according to a third embodiment of the invention, which comprises the same configuration as the circuit 1 according to the first embodiment of FIG. 2, except that the MOSFETs M1 to M4 are replaced with npn bipolar transistors Q1 to Q4, respectively. Therefore, the description about the same configuration is omitted here by attaching the same reference symbols as those in the first embodiment for the sake of simplification of description in FIG. 4.

In FIG. 4, the reference symbols $I_{C1}$, $I_{C2}$, $I_{C3}$, and $I_{C4}$ are collector currents of the transistors Q1, Q2, Q3, and Q4, respectively.

The circuit 1B of the third embodiment conducts substantially the same operation as the first embodiment. Thus, there are the same advantages as those in the first embodiment.

Fourth Embodiment

Figure 5:
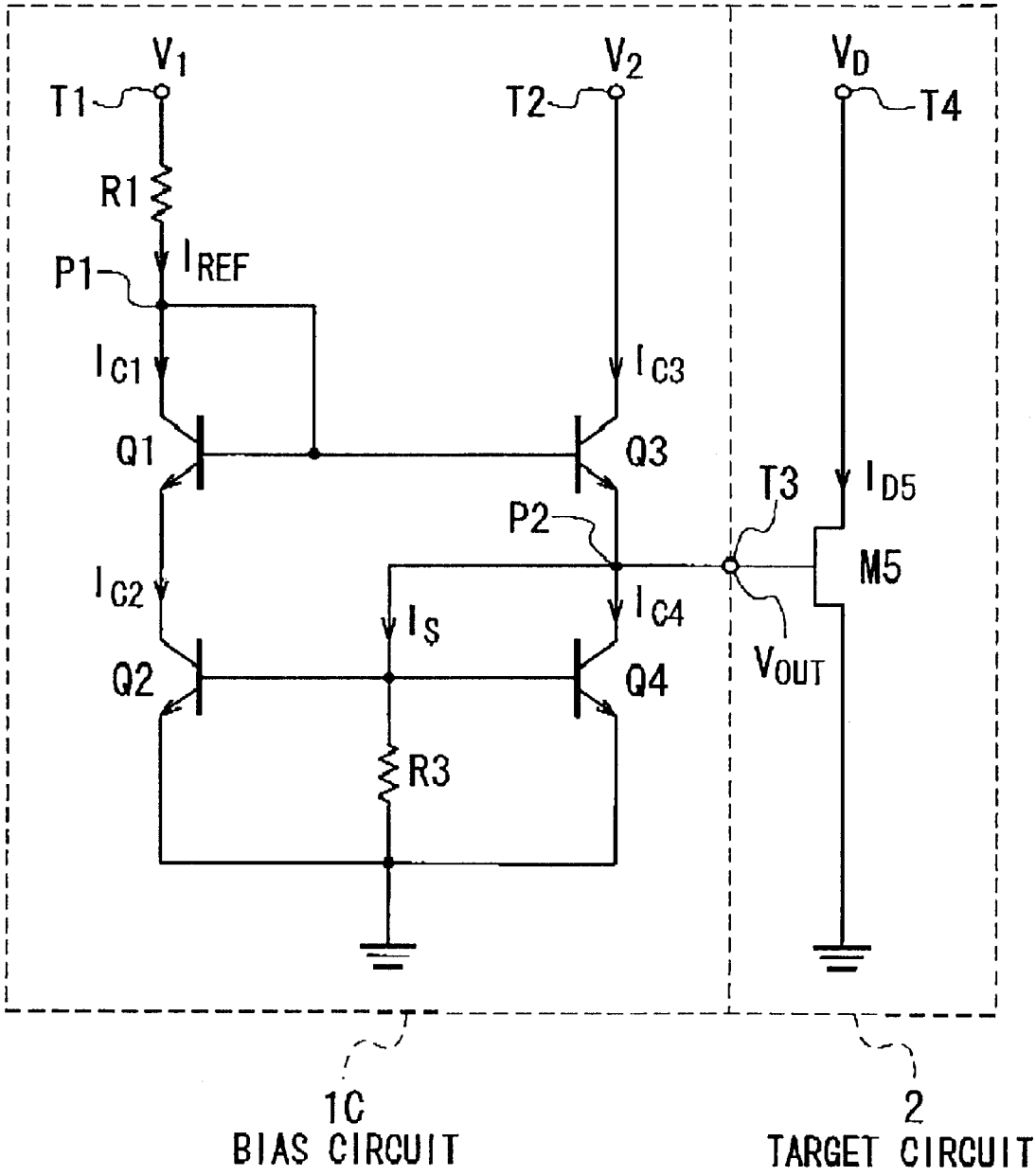
Fig 5 is a circuit diagram showing the configuration of an active bias circuit according to a fourth embodiment of the invention.

FIG. 5 shows an active bias circuit 1C according to a fourth embodiment of the invention, which comprises the same configuration as the circuit 1A according to the second embodiment of FIG. 3, except that the MOSFETs M1 to M4 are replaced with npn bipolar transistors Q1 to Q4, respectively. Therefore, the description about the same Configuration is omitted here by attaching the same reference symbols as those in the second embodiment for the sake of simplification of description in FIG. 5.

In FIG. 5, the reference symbols $I_{C1}$, $I_{C2}$, $I_{C3}$, and $I_{C4}$ are collector currents of the transistors Q1, Q2, Q3, and Q4, respectively.

The circuit 1C of the fourth embodiment conducts substantially the same operation as the second embodiment. Thus, there are the same advantages as those in the second embodiment.

Variations

Needless to say, the invention is not limited to the above-described first to fourth embodiments. For example, any type of a resistor may be used as the resistor R2 or R3 if it generates a specific voltage drop $V_R$ according to a current flowing through the same.

Instead of the MOSFETs M1 to M4 used in the first and second embodiments, any other type of FETs such as Metal-Semiconductor FETS (MESFETs) may be used. It is needless to say that the n-channel FETs may be replaced with p-channel FETs and that npn bipolar transistors may be replaced with pap bipolar transistors.

Furthermore, although the output bias voltage $V_{OUT}$ is applied to the gate of the enhancement MOSFET M5 in the target circuit 2 in the above embodiments, the invention is not limited to this case. Any other active element or device may be used if it is of the enhancement type and the voltage-driven type. Any other elements may be provided in the target circuit 2 along with the voltage-driven, active element of the enhancement type.

While the preferred forms of the present invention have been described, it is to be understood that modifications will be apparent to those skilled in the art without departing from the spirit of the invention The scope of the present invention, therefore, is to be determined solely by the following claims.

What is claimed is:

1. An active bias circuit comprising:

(a) a first transistor with a diode connection;
the first transistor being supplied with a reference current by way of a first resistor;
the first transistor having a control terminal;

(b) a second transistor connected in cascode to the first transistor;
the second transistor having a control terminal;

(c) a third transistor having a control terminal connected to the control terminal of the first transistor;
a constant current with a specific ratio with respect to the reference current flowing through the third transistor;

(d) a fourth transistor with a diode connection;
the fourth transistor being connected in cascode to the third transistor;
the fourth transistor having a control terminal connected to the control terminal of the second transistor;

(e) an output terminal formed between the third and fourth transistors connected in cascode;
an output bias voltage being derived from the output terminal,
the output bias voltage varying according to a reference voltage applied across the first and second transistors connected in cascode; and (f) a second resistor connected between the control terminal of the first transistor and the control terminal of the third transistor;

wherein an absolute value of the output bias voltage is decreased with a voltage drop of the second resistor that is generated by a current flowing through the second resistor.

2. The circuit according to claim 1, wherein the absolute value of the output bias voltage reaches 0 V before the absolute value of the reference voltage reaches 0 V from a specific value.

3. The circuit according to claim 1, wherein the active bias circuit is so designed that the output bias voltage is applied to a control terminal of a voltage-driven active element operable in an enhanced mode provided in a target circuit;

and wherein the absolute value of the output bias voltage reaches a value for cutting off the element in the target circuit before the absolute value of the reference voltage reaches 0 V from a specific value.

* * * * *